US006332554B1

(12) United States Patent
McCarthy

(10) Patent No.: US 6,332,554 B1
(45) Date of Patent: Dec. 25, 2001

(54) STORAGE BOX

(75) Inventor: Peter McCarthy, Woodbrige (CA)

(73) Assignee: Royal Group Technologies Limited, Woodbridge ( * ) Notice: Subject to any disclaimer, the term of this patent is extended or adjusted under 35 U.S.C. 154(b) by 0 days.

(21) Appl. No.: 09/469,470

(22) Filed: Dec. 22, 1999

(30) Foreign Application Priority Data

Dec. 22, 1998 (CA) ..... 2256825

(51) Int. Cl.[7] ..... B65D 51/00
(52) U.S. Cl. ..... 220/554; 220/908; 220/503
(58) Field of Search ..... 220/554, 908, 220/1.5, 503

(56) References Cited

U.S. PATENT DOCUMENTS 3,797,643 * 3/1974 Shupp ..... 220/503 X
5,076,458 * 12/1991 Weiner et al. ..... 220/908 X
5,088,616 * 2/1992 Susko et al. ..... 220/908 X
5,564,586 * 10/1996 Goodwin ..... 220/908 X
5,967,361 * 10/1999 Darnell ..... 220/908 X

* cited by examiner

*Primary Examiner*—Steven Pollard

(57) ABSTRACT

A storage box comprises a rectangular bottom, a rear wall, a front wall, a first end wall closing one end of said box, a second end wall hinged to one of the front and rear walls for opening and closing the other end of the box and a cover hinged to the rear wall for opening and closing the box at the top, the box being dimensioned to permit a lawnmower or the like to be run into said box through the end with the hinged end wall swung open and then stored within the box with the hinged end and the cover closed.

4 Claims, 4 Drawing Sheets

STORAGE BOX

FIELD OF THE INVENTION

This invention relates to a storage box particularly useful for outdoor storage of heavy and awkward to handle outdoor equipment such as lawnmowers and snowblowers as well as other implements such as gardening tools, snow shovels and other items.

More particularly, the invention is directed to providing such a storage box which enables both the heavy and awkward to handle equipment and the lighter easier to handle items to be inserted and removed with equal facility.

BACKGROUND OF THE INVENTION

When not in use, some place such as a garage or shed is required to store lawnmowers, snowblowers, their fuel containers, garden tools and other equipment of all kinds. When space in a garage or shed is not available or convenient, frequently an outdoor storage box is relied upon. Such storage boxes normally have a hinged top cover giving access to the interior thereof. In some cases, the storage box may have a front wall which also opens to assist in the placement into the box of a lawnmower or snowblower so that it does not have to be lifted over the sides and then lowered into the box. However, maneuvering such a heavy piece of equipment into the box still requires a strenuous effort. Moreover, many of such prior art storage boxes deteriorate with weathering, are unsightly and require maintenance.

SUMMARY OF THE INVENTION

The present invention in its broad aspect resides in providing a storage box or container which will enable a lawnmower, snowblower or the like to be simply run into the box from one end without requiring any manipulation or maneuvering thereof in the box while at the same time providing full access to the interior of the box through the top for the insertion and removal of other implements or items.

In another aspect, the invention provides such a storage box of sturdy, low cost construction which will be weather impervious and free of maintenance. In this regard, the storage box is formed with plastic material and comprises a rectangular bottom or base, a rear wall, a front wall, a fixed end wall closing one end of the box, a second end wall hinged to one of the front and rear walls for opening and closing the other end of the box, and a cover hinged to the rear wall for opening and closing the box at the top, the box being dimensioned to permit a lawnmower or the like to be run into the box with the hinged end open and stored within the box with the hinged end and cover closed.

More particularly according to this aspect of the invention, the rear, front and end walls are hollow being formed of plastic extrusions having spaced exterior and interior walls joined by transverse webs to provide rows of vertically extending compartments. Preferably, the cover is also hollow having spaced exterior and interior walls joined by transverse webs to provide internal compartments.

According to the preferred form of the invention, the hinged cover is provided with means to engage the hinged end wall when the hinged end wall and cover are closed to lock the end wall in the closed position.

Again, according to the preferred form of the invention, the rear wall is higher than the front wall and the hinged end wall is hinged to the front wall.

Still further according to the preferred form of the invention, the bottom or base is provided with a border of spaced upstanding posts adapted to be sleeved up into selected ones of the vertical compartments of the rear, front and the fixed end wall.

Still further according to the preferred form of the invention, the bottom or base is a compression molded body formed of composite material comprising particles of filler material bound together with a thermoplastic binder.

DETAILED DESCRIPTION ACCORDING TO THE PREFERRED EMBODIMENTS OF THE PRESENT INVENTION

Figure 1:
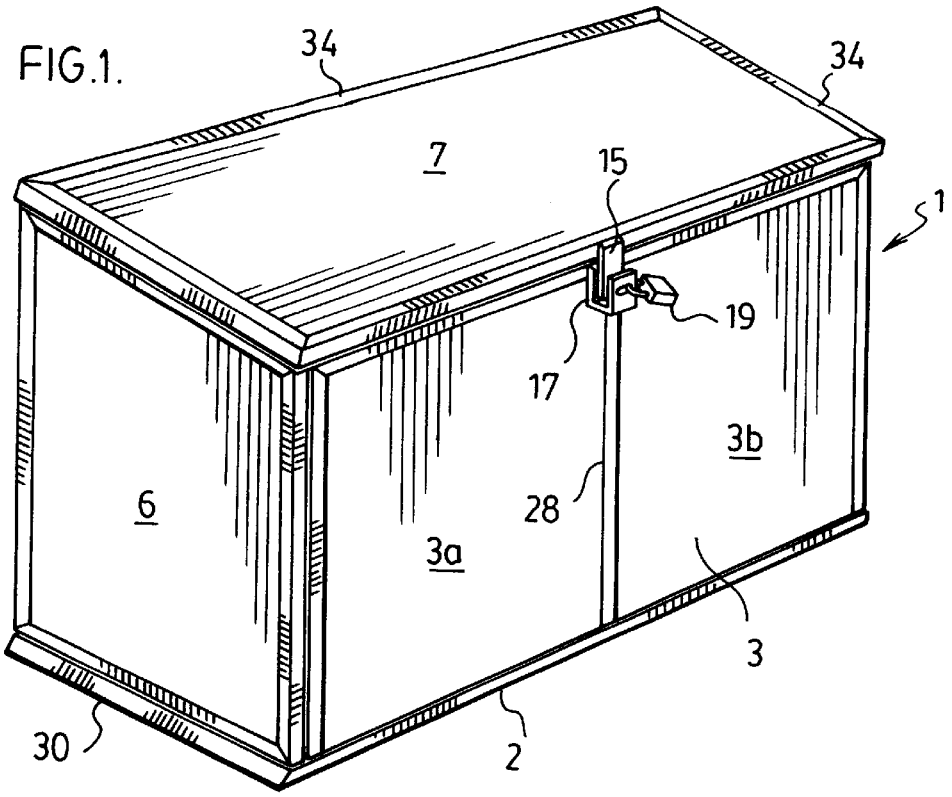
FIG. 1 is a perspective view of a storage box embodying the invention with the box closed.
Figure 2:
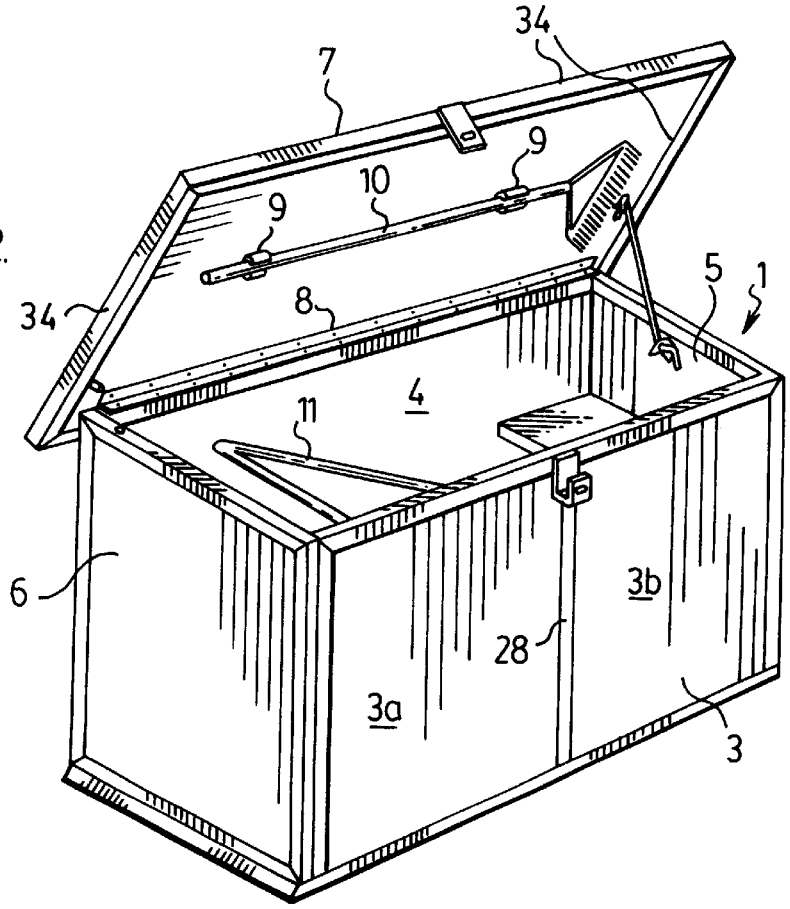
FIG. 2 is a perspective view of the storage box with the cover opened and a lawnmower stored therein.

With reference to FIGS. 1 and 2, the storage box of the invention generally designated at 1 has a rectangular bottom or base 2, a front wall 3, a rear wall 4 which is higher than the front wall 3, a first end wall 5, a hinged end wall 6 and a hinged cover 7 secured to the rear wall 4 by a hinge 8.

Figure 3:
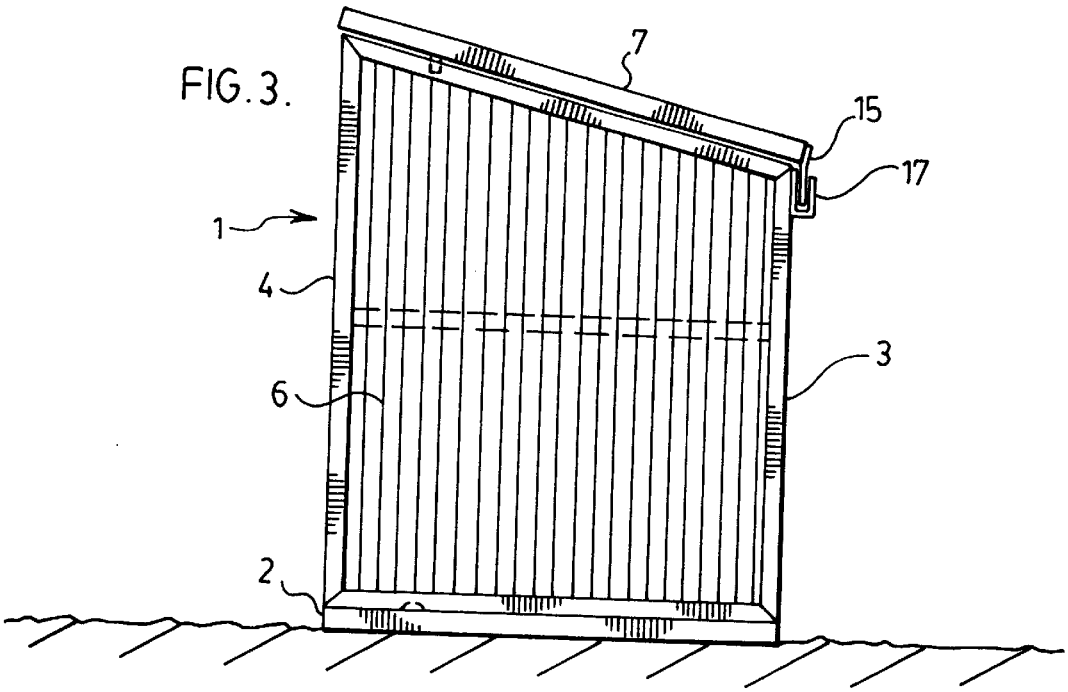
FIG. 3 is an end elevational view of the storage box closed.

As illustrated in FIG. 3, with the cover 7 closed it slopes from the rear towards the front of the box for run off of water or to allow for the sliding off of snow or ice.

Figure 4:
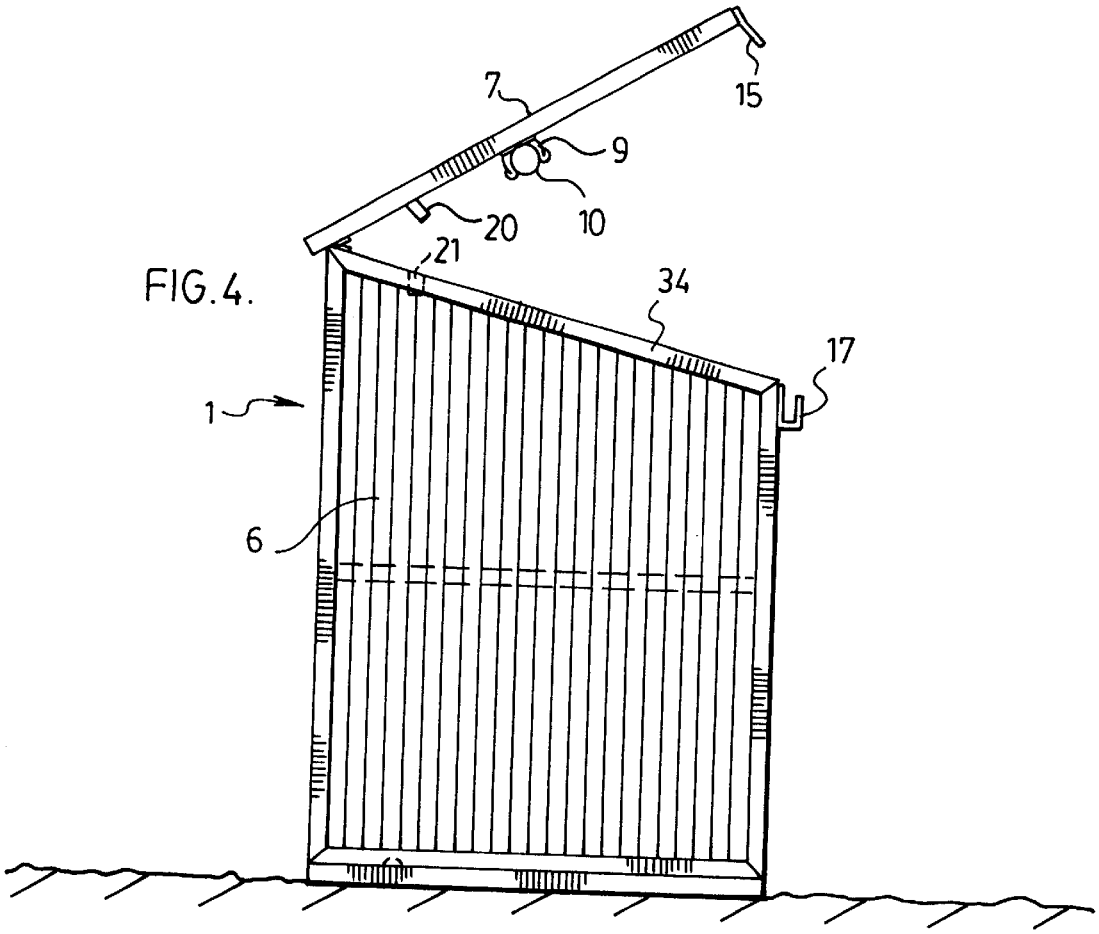
FIG. 4 is an end elevational view of the storage box with the cover in an open position.
Figure 5:
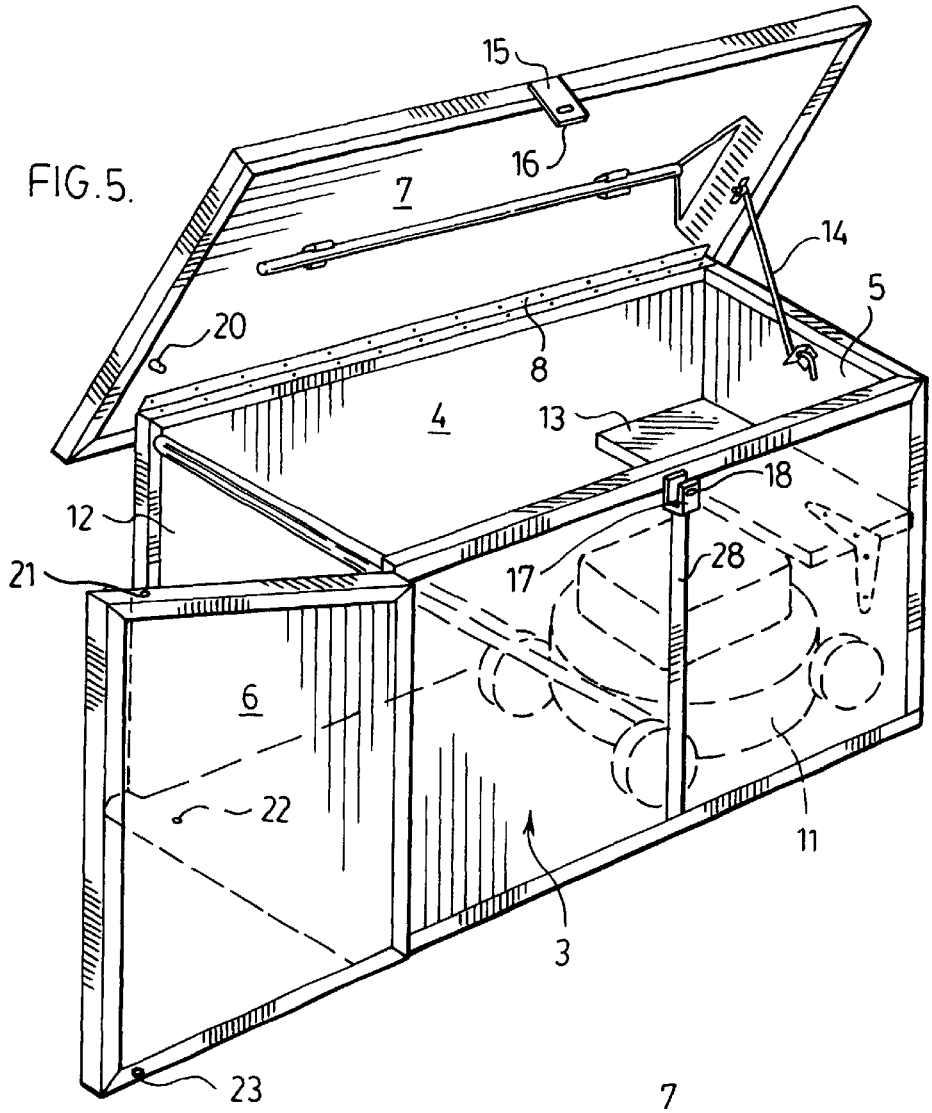
FIG. 5 is a perspective view of the storage box in which the cover and one end wall is shown in the open position and showing a lawnmower stored within the box.
Figure 6:
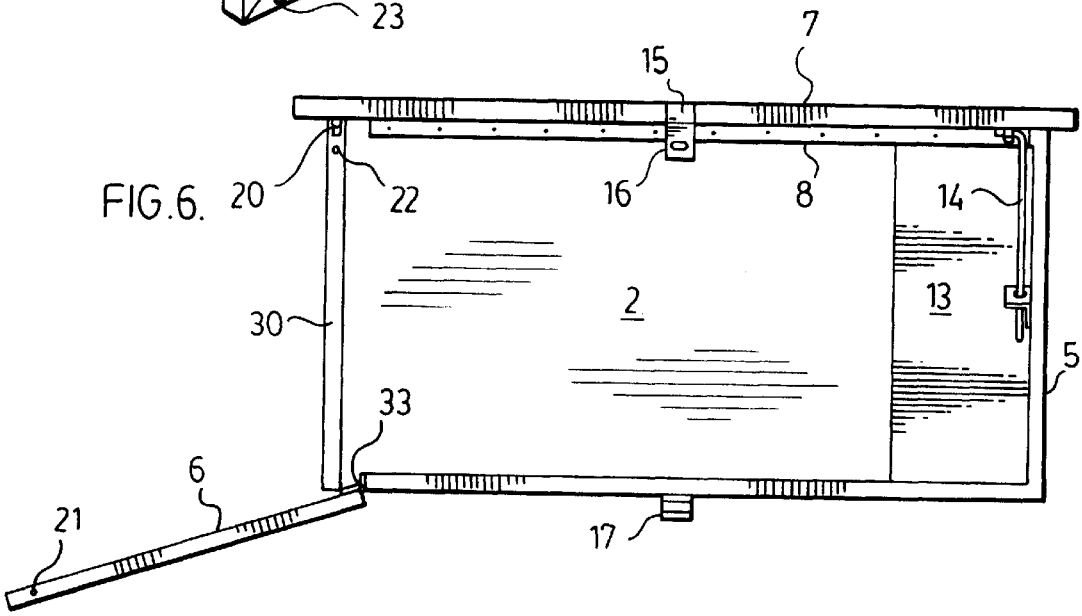
FIG. 6 is a planned view of the storage box with the cover and end wall in the fully open position.

As illustrated in FIGS. 2, 4 and 5, the underside of the cover 7 is provided with suitable mounting clips 9 for retaining garden implements such as the rake 10.

As illustrated in FIG. 5, the box is dimensioned so that with the hinged end wall 6 swung to the open position a lawnmower 11 may be run into the storage box through the open end 12 to be fully housed within the storage box without any maneuvering in the box when the hinged end wall 6 is closed as illustrated in FIG. 2.

Provided within the storage box 1 adjacent the end wall 5 is a shelf 13 bridging between the front wall 3 and the rear wall 4 on which gasoline and oil cans and other items can be set.

The storage box 1 is provided with a suitable cover supporting mechanism 14 to enable the cover to be held in the open position. The storage box is also provided with means for locking the cover in the closed position shown as a strap 15 carried by the front edge of the cover having an opening 16 therein to be received in a bracket 17 mounted on the front wall 3 of the box and provided with an opening 18 adapted to register with the opening 16 when the cover 7 is closed to receive the pad lock 19.

To lock the hinged end wall 6 in the closed position, the cover 7 is provided with a locking pin 20 which, with the hinged wall closed and the cover moved to the closed position, the pin will enter an opening 21 in the upper edge of the hinged end wall 6 preventing opening of the end wall while the cover is closed.

To ensure accurate registration of the cover pin 20 and the hinged end wall opening 21, the base 2 is provided with a locating bead 22 adapted to enter a recess 23 in the bottom edge of the hinged end.

While a storage box 1 may be made of different materials, it is another aspect of the invention to construct the box of plastic material formed to provide a sturdy, low cost, relatively light weight attractive weather impervious container in which, with the cover 7 closed, the walls and cover provide a measure of insulation to moderate interior ambient temperature changes.

Figure 7:
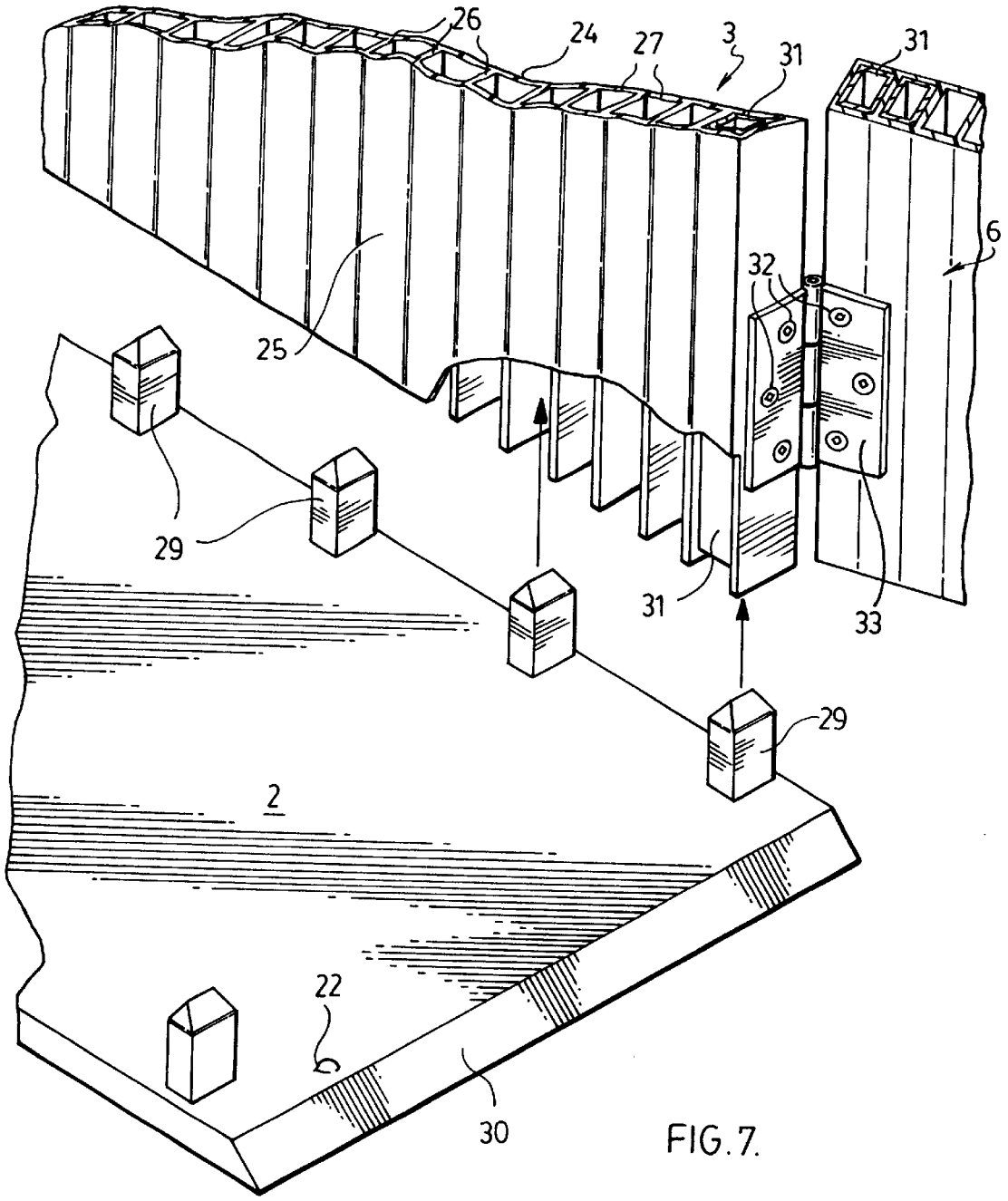
FIG. 7 is an enlarged perspective broken away view illustrating the bottom or base of the storage box on to which the front wall which carries the hinged wall is about to be mounted.

In this regard, reference is made to FIG. 7 wherein there is shown a portion of the front wall 3 which carries the hinged end wall 6 about to be mounted on the bottom or base 2.

The front wall 3 and as well the rear wall 4 and end walls 5 and 6 are formed from hollow extrusions each comprising an outer wall 24, an inner wall 25, the walls being joined by transverse webs 26 to provide a plurality of hollow compartments 27 which in the case of the various walls run perpendicularly of the wall.

As shown in FIGS. 1, 2 and 5, the front wall 3 is formed of two extruded panels 3*a* and 3*b* connected by a joiner 28 while the narrower end walls 5 and 6 may be a single panel. The rear wall 4 is formed in the same way as the front wall 3 and the cover 7 will also be of similar construction.

The bottom or base 2 is preferably formed as a compression molded solid block formed from filler or waste material such as sawdust, ground up thermosetting materials, paper, grain husks or other material, bound together in a compacted mat with a thermoplastic binder.

The bottom 2 is provided with a series of upwardly projecting posts 29 arranged at spaced intervals and extending around the perimeter thereof except at the end of the box having the hinged end wall 6.

It will be understood that the arrangement is such that the front, rear and end wall 3, 4 and 5 respectively are adapted to be sleeved down on to the posts 29 which are received in registering hollow compartments 27 of the extrusions whereby these walls 3, 4 and 5 are fixed to the bottom 2.

The bottom 2 is also provided with the hinged end locating bead 22 and, at the hinged end of the box 1, is provided with a ramp 30 to facilitate the entry of the lawnmower 11 or other device such as a snowblower.

It will be understood that the hollow compartments 27 provide air pockets which give a measure of insulation for the interior box when closed. These also serve as holding sleeves into which wood members 31 can be inserted as shown in FIG. 7 to provide additional wall strength and to provide increased holding power, for example, for the screws 32 of the hinge 33 hinging the end wall 6 to the front wall 3.

The exposed open ends of the compartments 27 are closed with suitable plastic capping and trimming members 34.

The walls and cover may be extruded from any suitable plastic such as PVC and may be covered with a suitable cap stock which contains weathering protection agents and which gives a very smooth surface. The cap stock may also include impact resisting agents, coloring and other agents as desired as will be understood in the art.

In this construction aspect of the invention, there is thus provided a storage box of attractive appearance which will be impervious to weather, will provide smooth surfaces off which snow and ice will slide and rain will run and which will provide a measure of insulation to protect the interior against temperature extremes which might affect material such as gasoline stored within the box.

Although various preferred embodiments of the present invention have been described herein in detail, it will be appreciated by those skilled in the art, that variations may be made thereto without departing from the scope of the appended claims.

The embodiments of the invention in which an exclusive property or privilege is claimed are defined as follows:

1. A storage box comprising a rectangular bottom, a rear wall, a front wall, a first end wall closing one end of said box, a second end wall hinged to one of said front and rear walls for opening and closing the other end of said box and a cover hinged to said rear wall for opening and closing said box at the top, said cover having means to engage said hinged end wall when said hinged wall is closed to lock said hinged wall in the closed position when said cover is closed, said box being dimensioned to permit a lawnmower or the like to run into said box through said other end with said hinged end wall swung open and stored within said box with said hinged end and said cover closed, said front, rear and end walls being comprised of hollow plastic extrusions having spaced inner and outer walls connected by transverse webs dividing the interior thereof into a plurality of vertically extending compartments and said bottom is provided with a border of spaced upstanding posts adapted to be sleeved up into internal compartments of said rear, front and first end wall.

2. A storage box as claimed in claim 1 in which said bottom is a compression molded block formed of composite material comprising particles of filler material bound together with a thermoplastic binder.

3. A storage box comprising a rectangular bottom, a rear wall, a front wall, a first end wall closing one end of said box, a second end wall hinged to one of said front and rear walls for opening and closing the other end of said box and a cover hinged to said rear wall for opening and closing said box at the top, said cover having means to engage said hinged end wall when said hinged end wall is closed to lock said hinged end wall in the closed position when said cover is closed and said bottom is provided with a border of spaced upstanding posts adapted to be sleeved up into internal compartments of said rear, front and first end wall.

4. A storage box as claimed in claim 3 in which said bottom is a compression molded block formed of composite material comprising particles of filler material bound together with a thermoplastic binder.

* * * * *